US012677914B2

(12) United States Patent
Lianglin

(10) Patent No.: US 12,677,914 B2
(45) Date of Patent: Jul. 14, 2026

(54) RETRACTABLE ZIPPER WITH Y-SHAPED TAPE

(71) Applicant: HANGZHOU GEMA SUITCASES & BAGS CO., LTD., Hangzhou (CN)

(72) Inventor: Wu Lianglin, Hangzhou (CN)

( * ) Notice: Subject to any disclaimer, the term of this patent is extended or adjusted under 35 U.S.C. 154(b) by 81 days.

(21) Appl. No.: 18/986,779

(22) Filed: Dec. 19, 2024

(65) Prior Publication Data

US 2025/0302159 A1 Oct. 2, 2025

(30) Foreign Application Priority Data

Mar. 28, 2024 (CN) ..... 202420620977.2

(51) Int. Cl.
*A44B 19/34* (2006.01)

(52) U.S. Cl.
CPC ..... *A44B 19/34* (2013.01)

(58) Field of Classification Search
CPC ..... A44B 19/34; A44B 19/32; A41D 2300/50
See application file for complete search history.

(56) References Cited

U.S. PATENT DOCUMENTS 12,144,408 B2 * 11/2024 Meersschaert ..... A45C 13/103
2011/0198175 A1 * 8/2011 Chiang ..... A45C 13/103 190/119
2013/0061434 A1 * 3/2013 Hampton ..... B23P 6/00 29/402.09
2013/0250604 A1 * 9/2013 Huang ..... F21V 33/0008 362/555
2014/0245519 A1 * 9/2014 Ly ..... A44B 19/34 2/93
2022/0087372 A1 * 3/2022 Roup ..... B29D 5/00
2023/0062734 A1 * 3/2023 Meersschaert ..... A44B 19/26

* cited by examiner

*Primary Examiner* — David M Upchurch
(74) *Attorney, Agent, or Firm* — Prakash Nama; Global IP Services, PLLC

(57) ABSTRACT

The utility model relates to the technical field of zippers, and particularly to a retractable zipper with a Y-shaped tape. The aesthetics of an existing zipper is affected after a stitching line is deflected. A retractable zipper with a Y-shaped tape comprises a main body, wherein the main body comprises a first tape, a second tape and a third tape; a first zipper structure and a second zipper structure are arranged between the first tape and the second tape and between the third tape and the second tape, respectively; sides of the first tape and the third tape away from the second tape are provided with a Y-shaped tape structure, respectively; each Y-shaped tape structure comprises an upper tape and a lower tape, and a stitching gap is formed between the upper tape and the lower tape. The upper tape is turned over, the lower tape is pierced by a needle to stitch and fix the zipper and the case shell together, and when stitching is completed, the upper tape is put back to cover a stitching line, so that the aesthetics of a product will not be affected even if the stitching line is deflected. The utility model has a good development prospect.

7 Claims, 2 Drawing Sheets

RETRACTABLE ZIPPER WITH Y-SHAPED TAPE

TECHNICAL FIELD

The utility model relates to the technical field of zippers, and particularly to a retractable zipper with a Y-shaped tape.

BACKGROUND

For an existing luggage case with a zipper having no leather lace but having visible stitching lines, when the zipper and a case shell are stitched together by a worker through mechanical equipment, a stitching line is easy to deflect, which will affect the aesthetics and result in a low production efficiency.

A Chinese utility model patent CN217284960U provides a double-layer retractable surrounding zipper, wherein sides of a first tape and a third tape away from a second chain rack are covered with a protective layer, respectively; the protective layers are made of chain adhesive or protective cloth covered with the chain adhesive on the surface; the structure is in adhesive connection with the zipper, and is essentially an additional structure on the zipper; the solution directly improves the tapes of the zipper, and designs a zipper with the aesthetics not affected even if the stitching line is deflected.

SUMMARY

To solve the above technical problem, the purpose of the utility model is to provide a retractable zipper with a Y-shaped tape and solve the problem that the aesthetics of an existing zipper is affected after a stitching line is deflected.

To achieve the above purpose, the utility model adopts the following technical solution: a retractable zipper with a Y-shaped tape, comprising a main body, wherein the main body comprises a first tape, a second tape and a third tape; a first zipper structure and a second zipper structure are arranged between the first tape and the second tape and between the third tape and the second tape, respectively; sides of the first tape and the third tape away from the second tape are provided with a Y-shaped tape structure, respectively; each Y-shaped tape structure comprises an upper tape and a lower tape, and a stitching gap is formed between the upper tape and the lower tape.

By adopting the above technical solution, the upper tape is folded in a direction approaching the second tape, the lower tape is pierced by a needle of sewing equipment to stitch and fix the zipper and the case shell together, and when stitching is completed, the upper tape is put back to cover a stitching line, so that the aesthetics of a product will not be affected even if the stitching line is deflected; a space is reserved by the stitching gap for the stitching line, so that when the stitching is completed, the upper tape remains flush with the first tape or the third tape, which will avoid bulging or turning over and ensure good aesthetics of the product.

Further, an opening of each Y-shaped tape structure faces toward an outer side of the main body.

By adopting the above technical solution, the upper tape is prevented from turning over and affecting the sight of an operator.

Further, the length of the upper tape is greater than that of the lower tape.

By adopting the above technical solution, the lower tape can be completely covered by the upper tape, which has no difference from an ordinary tape in appearance.

Further, at least one of the first zipper structure and the second zipper structure is a retractable zipper structure.

By adopting the above technical solution, a zipper with a variable width is formed, which can be extended or retracted with the space of the luggage case.

Further, the retractable zipper structure comprises a fourth tape, a first tooth chain and a second tooth chain.

Further, the first tooth chain is arranged on the first tape, the second tooth chain is arranged on the second tape, the fourth tape is connected with the first tape and the second tape and wraps the first tooth chain and the second tooth chain, and the first tooth chain and the second tooth chain are connected by a slider.

By adopting the above technical solution, the width of the zipper can be extended or retracted.

Further, the Y-shaped tape structures are made of TPU, and the first tape and the third tape are integrated with the Y-shaped tape structures, respectively.

By adopting the above technical solution, production is convenient.

Compared with the prior art, the present invention has the advantages that: 1. the Y-shaped tape structures are adopted, which can hide the stitching line without affecting a stitching operation of the operator, reduce the operation difficulty and improve the aesthetics of the product; 2. the design of the Y-shaped tape structures is reasonable; as a part of the zipper, the tapes have a good integrity, and the problems of shedding and secondary operation of the zipper after stitching will not occur; 3. with the retractable zipper structure, the width of the tapes is effectively extended, which is adapted to the requirements of luggage cases with different specifications and has a wide application range.

DETAILED DESCRIPTION

The utility model is further described below in detail in combination with the drawings and embodiments.

Figure 1:
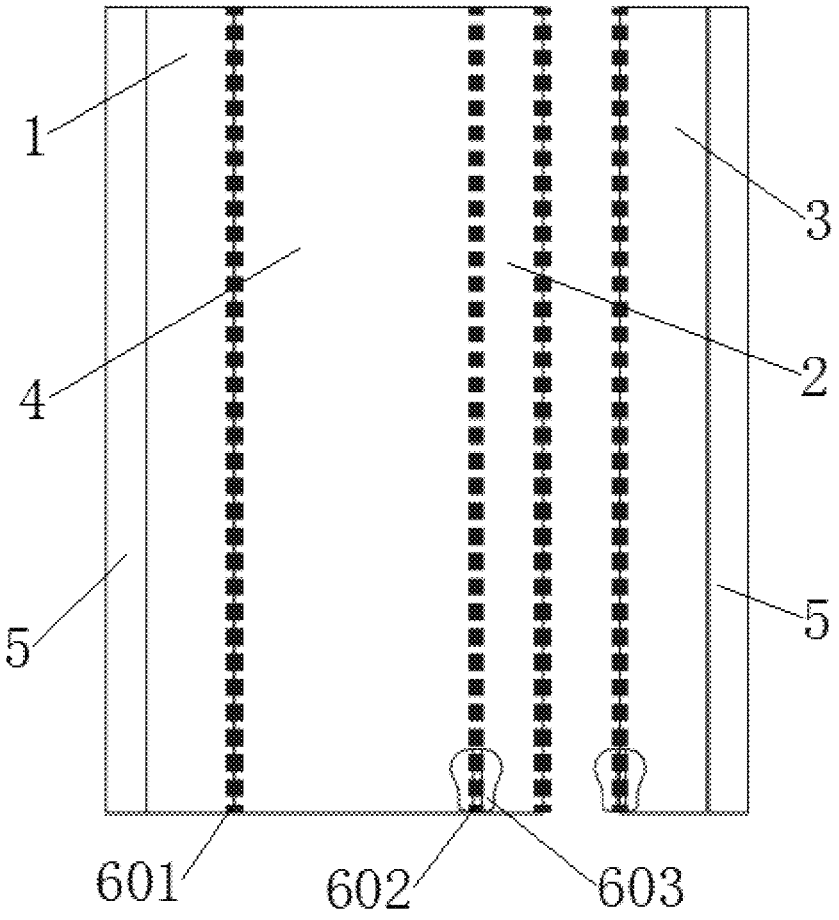
FIG. 1 is a top structural schematic diagram of the utility model.
Figure 2:
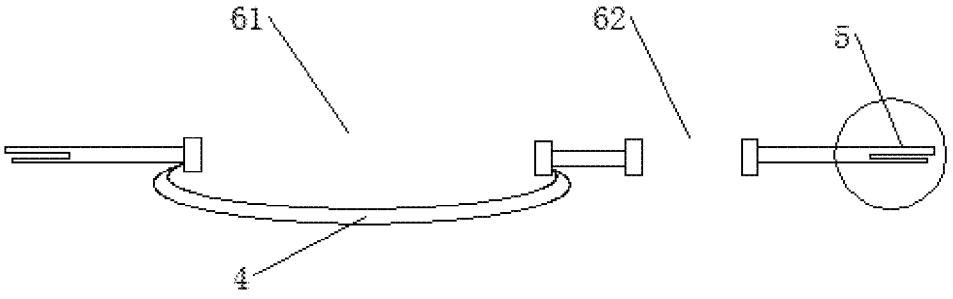
FIG. 2 is a side structural schematic diagram of the utility model.
Figure 3:
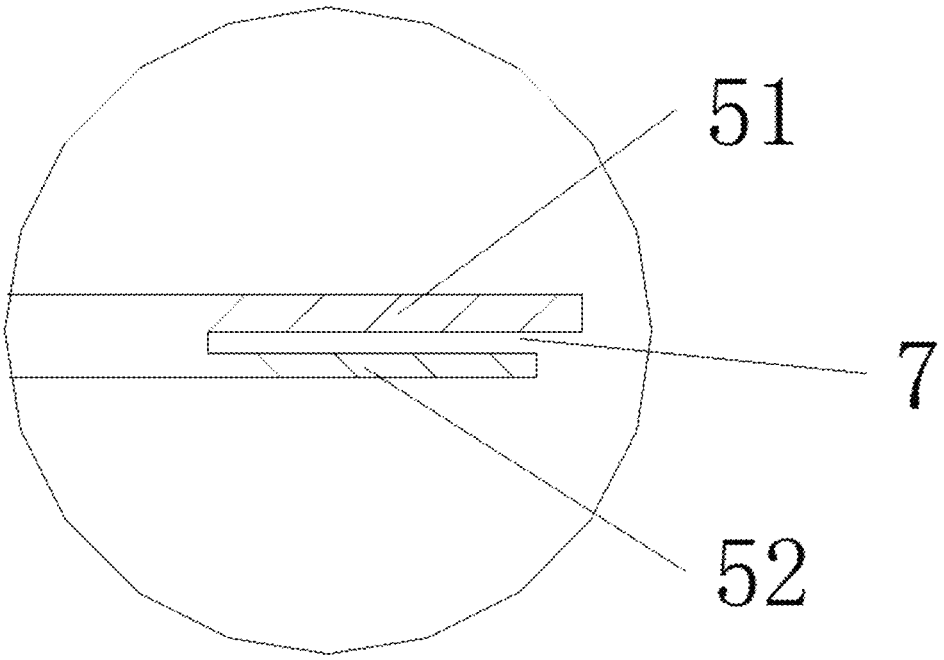
FIG. 3 is an amplified structural schematic diagram of a Y-shaped tape structure of the utility model.
Figure 4:
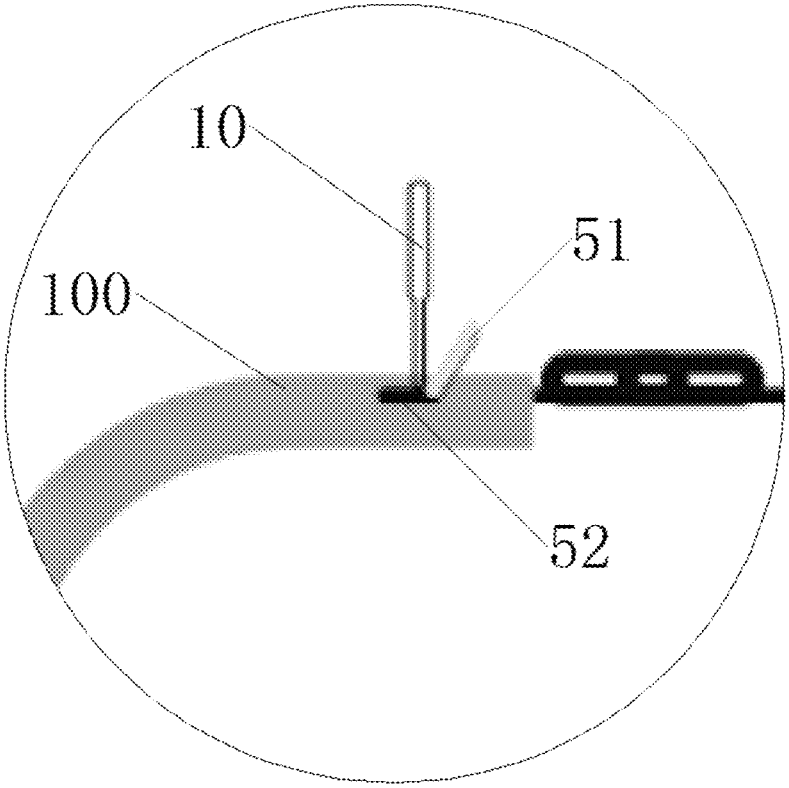
FIG. 4 is a schematic diagram of a stitching operation of the utility model.

Embodiment 1: as shown in FIG. 1 to FIG. 4, a retractable zipper with a Y-shaped tape comprises a main body, wherein the main body comprises a first tape 1, a second tape 2 and a third tape 3; a first zipper structure 61 and a second zipper structure 62 are arranged between the first tape 1 and the second tape 2 and between the third tape 3 and the second tape 2, respectively; sides of the first tape 1 and the third tape 3 away from the second tape 2 are provided with a Y-shaped tape structure 5, respectively; each Y-shaped tape structure 5 comprises an upper tape 51 and a lower tape 52, and a stitching gap 7 is formed between the upper tape 51 and the lower tape 52; an opening of each Y-shaped tape structure 5 faces toward an outer side of the main body, and the length of the upper tape 51 is greater than that of the lower tape 52.

In embodiment 2, based on embodiment 1, the first zipper structure 61 is a retractable zipper structure.

The difference from embodiment 2 is that the second zipper structure 62 is a telescopic zipper structure.

In embodiment 3, based on embodiment 1, both the first zipper structure 61 and the second zipper structure 62 are retractable zipper structures.

Based on the above embodiment, each retractable zipper structure comprises a fourth tape 4, a first tooth chain 601 and a second tooth chain 602, wherein the first tooth chain 601 is arranged on the first tape 1, the second tooth chain 602 is arranged on the second tape 2, the fourth tape 4 is connected with the first tape 1 and the second tape 2 and wraps the first tooth chain 601 and the second tooth chain 602, and the first tooth chain 601 and the second tooth chain 602 are connected by a slider 603.

Based on the above embodiment, the Y-shaped tape structures 5 are made of TPU, and the first tape 1 and the third tape 3 are integrated with the Y-shaped tape structures 5, respectively.

The utility model has the working principle that: during stitching, the upper tape 51 is pushed aside to avoid affecting the sight of the operator, the lower tape 52 is stitched by a needle 10 to fix the zipper and a case shell 100 together, and when stitching is completed, the upper tape 51 is covered on the lower tape 52 to shield a stitching line.

Although preferred embodiments of the utility model are described in detail above, it should be clearly understood that for those skilled in the art, various variations and changes can be made to the utility model. Any modification, equivalent replacement and improvement made within the spirit and the principle of the utility model shall be included within the protection scope of the utility model.

What is claimed is:

1. A retractable zipper with a Y-shaped tape, comprising a main body, wherein the main body comprises a first tape (1), a second tape (2) and a third tape (3); a first zipper structure (61) and a second zipper structure (62) are arranged between the first tape (1) and the second tape (2) and between the third tape (3) and the second tape (2), respectively; sides of the first tape (1) and the third tape (3) away from the second tape (2) are provided with a Y-shaped tape structure (5), respectively; each Y-shaped tape structure (5) comprises an upper tape (51) and a lower tape (52), and a stitching gap (7) is formed between the upper tape (51) and the lower tape (52).

2. The retractable zipper with a Y-shaped tape according to claim 1, wherein an opening of each Y-shaped tape structure (5) faces toward an outer side of the main body.

3. The retractable zipper with a Y-shaped tape according to claim 1, wherein the length of the upper tape (51) is greater than that of the lower tape (52).

4. The retractable zipper with a Y-shaped tape according to claim 1, wherein the Y-shaped tape structures (5) are made of TPU, and the first tape (1) and the third tape (3) are integrated with the Y-shaped tape structures (5), respectively.

5. The retractable zipper with a Y-shaped tape according to claim 1, wherein at least one of the first zipper structure (61) and the second zipper structure (62) is a retractable zipper structure.

6. The retractable zipper with a Y-shaped tape according to claim 5, wherein the retractable zipper structure comprises a fourth tape (4), a first tooth chain (601) and a second tooth chain (602).

7. The retractable zipper with a Y-shaped tape according to claim 6, wherein the first tooth chain (601) is arranged on the first tape (1), the second tooth chain (602) is arranged on the second tape (2), the fourth tape (4) is connected with the first tape (1) and the second tape (2) and wraps the first tooth chain (601) and the second tooth chain (602), and the first tooth chain (601) and the second tooth chain (602) are connected by a slider (603).

* * * * *